US005584365A

United States Patent [19]

Tonna

[11] Patent Number: 5,584,365

[45] Date of Patent: Dec. 17, 1996

[54] TELESCOPING ELEVATOR DOOR SYSTEM

[75] Inventor: Christian G. Tonna, Sao Paulo, Brazil

[73] Assignee: Otis Elevator Company, Farmington, Conn.

[21] Appl. No.: 307,225

[22] Filed: Sep. 16, 1994

[51] Int. Cl.[6] ..... B66B 13/12

[52] U.S. Cl. ..... 187/319; 187/330

[58] Field of Search ..... 187/319, 320, 187/321, 324, 330; 49/120, 122

[56] References Cited

U.S. PATENT DOCUMENTS

| | | | |
|---|---|---|---|
| 1,966,182 | 7/1934 | McCormick | 268/48 |
| 2,235,380 | 3/1941 | McCormick | 187/319 |
| 4,781,270 | 11/1988 | Holland | 187/56 |
| 4,947,964 | 8/1990 | Husmann | 187/319 |
| 5,265,702 | 11/1993 | Garrido et al. | 187/56 |
| 5,323,876 | 6/1994 | McAllister et al. | 187/53 |

*Primary Examiner*—Kenneth Noland

[57] ABSTRACT

A telescoping elevator door apparatus for an elevator having a car for travel in a hoistway is provided. The door apparatus comprises a fast elevator door, a slow elevator door, a first drive, and a second drive. The fast and slow doors are positioned to operate between the car and a landing in the hoistway. In a first embodiment, the first drive selectively drives the fast elevator door open or closed and the second drive selectively drives the slow elevator door open or closed.

17 Claims, 2 Drawing Sheets

TELESCOPING ELEVATOR DOOR SYSTEM

BACKGROUND OF THE INVENTION

1. Technical Field

The present invention relates to elevators and, more particularly, to a telescoping door system for an elevator.

2. Background Information

Elevator systems typically include a car which can be drawn to any one of a plurality of landings within a hoistway to accommodate passengers. The car and each landing includes a doorway defined by at least one vertically extending jamb and a threshold extending across the bottom of the opening. For safety purposes, both the car and each of the hoistway landings comprise a door system to prevent access to the elevator car until the car is safely positioned at a particular landing.

Telescoping door systems, also known as two speed door systems, are a popular door system that can be arranged in a side opening configuration or a center opening configuration. In the side opening configuration, a fast door and a slow door are provided that extend across the doorway threshold in the door closed position or slide into a door pocket on one side of the doorway in the door open position. The stroke and the speed of the fast and slow doors are coordinated such that the fast door travels a greater distance than the slower door in approximately the same amount of time; hence the descriptive name "telescoping" or "two speed". The center opening configuration operates similarly except that there are two pairs of "side" opening doors included, one on each side of the opening. Each pair of doors extends across the doorway threshold and in contact with the other set of doors in the door closed position, or slides into a door pocket on the respective side of the doorway in the door open position.

The fast door may be more specifically described as comprising a fast car door panel and a fast hoistway door panel. The slow door comprises a slow car door panel and a slow hoistway door panel. When a car is properly positioned at a landing, the fast cab door panel and the fast hoistway door panel are positioned adjacent each other and the slow cab and hoistway panels are positioned outside of the fast door panels; i.e., on the opposite sides of the respective fast panels. In the door open position, the fast and slow panels are tucked into the door pocket parallel one another, with the fast panels positioned between the slow panels. The edge of the door panel on the jamb side of the doorway is defined as the leading edge and the edge of the door panels on the opposite, or "pocket side", of the doorway is defined as the terminal edge. When the doors are extended across the doorway threshold (i.e., the closed position), the leading edge of the fast door is either in contact with the jamb (the side opening configuration) or in contact with the leading edge of the other fast door (the center opening configuration). In this position, the leading edge of the slow door(s) is in close proximity to the terminal edge of the fast door.

There are a number of ways known to drive telescoping doors. In one embodiment, the drive assembly includes an electromechanical drive, a coupler for coupling the fast car door panel to the fast hoistway door panel, a first linkage for connecting the fast and slow car door panels, and a second linkage for connecting the fast and slow hoistway door panels. The coupler comprises a roller and vane combination. The rollers are attached to the fast car door panel and a vane is attached to every fast hoistway door panel. Alternatively, the rollers may be attached to every fast hoistway door panel and the vane attached to the fast car door panel. When the car enters the landing, the rollers are received within the vane, thereby coupling the fast car door panel and the fast hoistway door panel.

The first linkage is a mechanical linkage connecting the fast car door panel and the slow car door panel. Typically, the first linkage is a pivotal linkage attached to the fast car door panel and the slow car door panel at different radial points; i.e., if the fast door is to have twice the speed and travel, it is attached to the pivoting member at a distance away from the pivot point of the pivoting member twice that of the linkage connecting the slow door. The electromechanical drive is attached to the pivoting member on the side of the pivot point opposite that attached to the doors. Alternatively, the fast and slow car door panels could be attached to each other with an air cord assembly; i.e., a cable and pulley assembly where the slow door is roped to the fast door such that the speeds of the two doors are a multiple of one another.

The second linkage is similar to the first linkage except that it is applied to the hoistway door panels. The first and second linkages described heretofore connect the slow and fast doors of the car and hoistway such that movement of one of the fast door panels will cause the connected slow door panel to move as well. Furthermore, driving the first linkage with the electromechanical drive will cause both the hoistway and car doors to actuate because of the Coupling connecting the fast car and hoistway door panels.

Closing and opening times for doors are a vital consideration in elevatoring for several reasons. A person of skill in the art will recognize that it is desirable to minimize the time necessary to open and close elevator doors. Minimizing elevator door actuation time increases the efficiency of the elevator as well as the perception of quality. Safety codes dictate, however, that the closing speed of an elevator door is limited by a maximum allowable kinetic energy developed by the moving door.

The kinetic energy of an elevator door can be determined by using the kinetic energy equation, $K=\frac{1}{2} mv^2$, where "m" represents the total mass of the door system being moved and "v" represents the velocity of the door system being moved; i.e. distance traveled per unit time. The mass of the door system is generally computed by totaling the masses of all the individual pieces rigidly attached to the door; e.g., if all four door panels are mechanically connected, then the mass of all four door panels is summed in determining the kinetic energy of the door system. The velocity of the door is generally determined by averaging the speed of the door over a predetermined distance within the full travel of the door. From the equation it can be seen that the mass of the door is directly related to the kinetic energy of the door and the time component of the velocity is exponentially, inversely related. Hence, increasing the mass of the door increases the kinetic energy of the moving door, assuming the velocity is constant. Increasing the velocity of the door also increases the kinetic energy because the time component of the increased velocity is exponentially, inversely related. It is, therefore, difficult with presently known door drive arrangements to improve the closing speed of an elevator door without increasing the kinetic energy of the door(s).

DISCLOSURE OF THE INVENTION

It is, therefore, an object of the present invention to increase the efficiency of an elevator by decreasing the door opening and door closing times.

It is a further object of the present invention to provide a telescoping door system that minimizes the kinetic energy of the doors in motion.

According to the present invention, a telescoping elevator door apparatus for an elevator having a car for travel in a hoistway is provided. The door apparatus comprises a fast elevator door, a slow elevator door, a first drive, and a second drive. The fast and Slow doors are positioned to operate between the car and a landing in the hoistway.

In a first embodiment, the first drive selectively drives the fast elevator door open or closed and the second drive selectively drives the slow elevator door open or closed. The fast elevator door comprises a fast car door panel attached to the elevator car and a fast hoistway door panel attached to a landing in the hoistway. The slow elevator door similarly comprises a slow car door panel attached to the elevator car and a fast hoistway door panel attached to the landing.

According to an aspect of the first embodiment, a first coupling couples the fast car door panel and fast hoistway door panel when the car is located at a landing and a second coupling couples the slow car door panel and the slow hoistway door panel when the car is located at a landing. The first drive thereby drives the coupled fast car and fast hoistway door panels. The second drive similarly drives the coupled slow car and slow hoistway door panels.

In a second embodiment, the fast elevator door comprises a fast car door panel attached to the elevator car. A slow car door panel is attached to a landing in the hoistway. The slow elevator door similarly comprises a slow car door panel attached to the elevator car and a slow hoistway door panel attached to the landing. A coupling couples the fast car door panel and fast hoistway door panels when the car is located at a landing, and a hoistway door linkage connects the fast and slow hoistway door panels. The first drive selectively drives the fast car and hoistway door panels and the connected slow hoistway door panel. The second drive drives the slow car door panel.

One advantage of both these embodiments is that the mass driven by either drive is less than it would be if a single drive drove both the fast and slow doors. Decreasing the mass decreases the kinetic energy of the telescoping door and thereby enables the elevator doors to be adjusted to a higher closing speed without exceeding the acceptable maximum kinetic energy.

Another advantage of the present invention is that it can be applied to telescoping doors that open either from the side or the center. In the center opening configuration, the door apparatus of the present invention is repeated on both sides of the doorway.

Still another advantage of the present invention is that two different embodiments are available. In some instances it may be more advantageous to have the fast doors coupled and the slow doors coupled. In other instances, it may be advantageous to have the hoistway doors coupled both together and coupled to the fast car door panel, and the slow car door panel driven independently.

The foregoing features and advantages of the present invention will become more apparent in light of the following detailed description of the best mode for carrying out the invention and accompanying drawings.

BEST MODE FOR CARRYING OUT THE INVENTION

Figure 1:
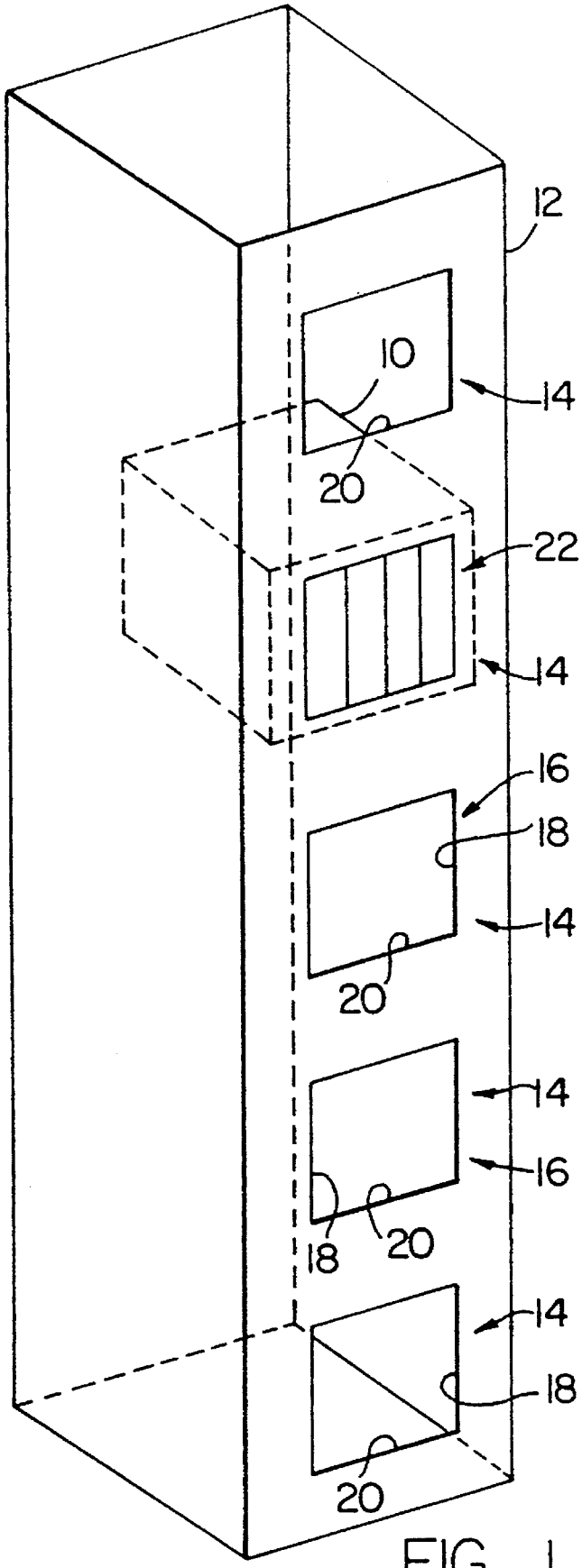
FIG. 1 is a diagrammatic view of an elevator.

Referring to FIG. 1, an elevator includes an elevator car 10 for guided travel within a hoistway 12. The hoistway 12 includes a plurality of landings 14 at which the car 10 may be directed to stop. The car 10 and each landing 14 includes a doorway 16 defined by at least one vertically extending jamb 18 and a threshold 20 extending across the bottom of the doorway 16. For safety purposes, both the car 10 and each of the hoistway landings 14 comprise a door system 22 to prevent access to the elevator car 10 until the car 10 is safely positioned at a particular landing 14.

Figure 2:
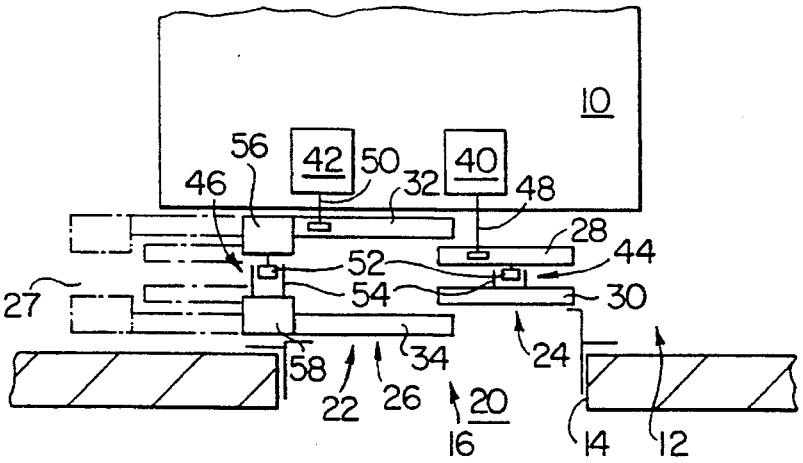
FIG. 2 is a diagrammatic top view of a first embodiment of a telescoping door system for a side opening elevator.

Referring to FIG. 2, in a first embodiment the door system 22 is a side opening configuration comprising a fast door 24 and a slow 26 door that either extend across the doorway threshold 20 in the door closed position or slide into a door pocket 27 on one side of the doorway 16 in the door open position. The fast 24 and slow 26 doors include a fast car door panel 28, a fast hoistway door panel 30, a slow car door panel 32, and a slow hoistway door panel 34. The fast 28 and slow 32 car door panels are slidably attached to the car 10, and therefore travel with the car 10 throughout the hoistway 12. A pair of the fast 30 and slow 34 hoistway panels are slidably attached at each landing 14.

When the car 10 is properly positioned at a landing 14, the fast car door panel 28 and the fast hoistway door panel 30 are positioned adjacent each other and the slow car 32 and hoistway 34 door panels are positioned on the opposite sides of the respective fast door panels 28,30. In the door open position, the fast 28,30 and slow door 32,34 panels are tucked into the door pocket 27 parallel one another, with the fast panels 28,30 positioned between the slow door panels 32,34 (shown in phantom in FIGS. 2–4).

A drive assembly attached to the car 10 drives the door system 22 open and closed. The drive assembly includes: (a) a first electromechanical drive 40 for driving the fast door 24, attached to the car 10; (b) a second electromechanical drive 42 for driving the slow door 26, attached to the car 10; (c) a first coupler 44 for coupling the fast car door panel 28 to the fast hoistway door panel 30; (d) a second coupler 46 for coupling the slow car door panel 32 to the slow hoistway door panel 34; (e) a first linkage 48 for connecting the first electromechanical drive 40 to the fast car door panel 28; and (f) a second linkage 50 for attaching the second electromechanical drive 42 to the slow car door panel 32. The first 40 and second 42 electromechanical drives may alternatively be attached to the hoistway landing 14 and the linkages 48,50 connected to the hoistway doors 30,34 (not shown).

The first 44 and second 46 couplers each comprise a roller 52 and vane 54 arrangement. The rollers 52 are attached to the fast car door panel 28 and to a flange 56 attached to the slow car door panel 32. A vane 56 is attached to every fast hoistway door panel 30 and to a second flange 58 attached to every slow hoistway panel 34. When the car 10 enters the landing 14, the rollers 52 are received within the vanes 54, thereby coupling the fast door panels 28,30 of the car 10 and hoistway 12 and the slow car door panel 34 of the hoistway. Alternatively, the vanes 54 may be attached to the car door panels 28,32 and the rollers 52 attached to the hoistway door panels 30,34.

Figure 3:
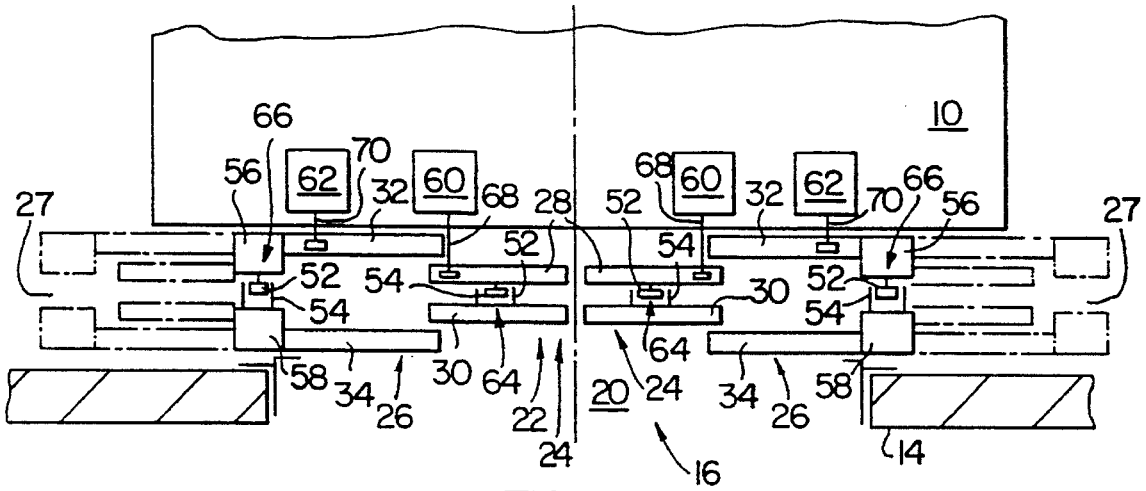
FIG. 3 is a diagrammatic top view of a telescoping door system for a center opening elevator.

Referring to FIG. 3 in a second embodiment, the door system 22 is a center opening configuration comprising a pair of fast doors 24 and a pair of slow doors 26 that either extend across the doorway threshold 20 in the door closed position or slide into a door pocket 27 on each side of the doorway 16 in the door open position. Similar to the side opening configuration, each fast door 24 includes a fast car door panel 28 and a fast hoistway door panel 30. Each slow door 26 comprises a slow car door panel 32 and a slow hoistway door panel 34. The fast 28 and slow 32 car door panels are slidably attached to the car 10, and therefore travel with the car 10 throughout the hoistway 12. A pair of the fast 30 and slow 34 hoistway panels are slidably attached at each landing 14.

A drive assembly similar to that used in the side opening configuration drives the center opening door system open and closed. Specifically, the drive assembly of the side configuration is mirrored for the two sets of fast 24 and slow 26 speed doors. The drive assembly for each set of doors includes: (a) a first electromechanical drive 60 for driving the fast door 24, attached to the car 10; (b) a second electromechanical drive 62 for driving the slow door 26, attached to the car 10; (c) a first couple 64 for coupling the fast car door panel 28 to the fast hoistway door panel 30; (d) a second coupler 66 for coupling the slow car door panel 32 to the slow hoistway door panel 34; (e) a first linkage 68 for connecting the first electromechanical drive 60 to the fast car door panel 28; and (f) a second linkage 70 for attaching the second electromechanical drive 62 to the slow car door panel 32. The first 60 and second 62 electromechanical drives may alternatively be attached to the hoistway landing 14 and the linkages 68,70 attached to the hoistway door panels 30,34. The first 64 and second 66 couplers comprise a roller 52 and vane 54 combination as is described heretofore.

Figure 4:
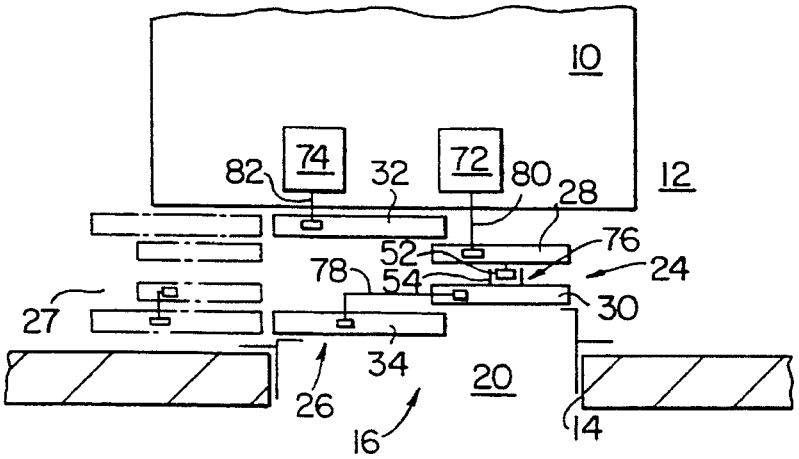
FIG. 4 is a diagrammatic top view of a second embodiment of a telescoping door system for a side opening elevator.

Referring to FIG. 4, in a third embodiment the door system 22 is a side opening configuration comprising a fast door 24 and a slow door 26 that either extend across the doorway threshold 20 in the door closed position or slide into a door pocket 27 on one side of the doorway 16 in the door open position. The fast 24 and slow 26 doors include a fast car door panel 28, a fast hoistway door panel 30, a slow car door panel 32, and a slow hoistway door panel 34. The fast 28 and slow 32 car door panels are slidably attached to the car 10, and therefore travel with the car 10 throughout the hoistway 12. A pair of the fast 30 and slow 34 hoistway panels are slidably attached at each landing 14.

In the third embodiment, a drive assembly attached to the car 10 drives the door system 22 open and closed. The drive assembly includes: (a) a first electromechanical drive 72 for driving the fast car door panel 28, the fast hoistway door panel 30, and the slow hoistway door panel 34; (b) a second electromechanical drive 74 for driving the slow car door panel 32; (c) a coupler 76 for coupling the fast car door panel 28 to the fast hoistway door panel 30; (d) a first linkage 78 for connecting the fast 30 and slow 34 hoistway door panels; (e) a second linkage 80 for connecting the first electromechanical drive 72 to the fast car door panel 28; and (f) a third linkage 82 for attaching the second electromechanical drive 74 to the slow car door panel 32. In the preferred embodiment, the first 72 and second 74 electromechanical drives are attached to the car 10 and therefore travel within the hoistway 12 with the car 10.

The first linkage 78 connecting the fast 30 and slow 34 hoistway door panels connects the door panels 30,34 such that the stroke and speed of the fast hoistway door panel 30 are a multiple of the stroke and speed of the slow hoistway door panel 34; e.g., twice the travel at twice the speed. The coupler 76 is a roller 52 and vane 54 combination as described heretofore. Together, the first linkage 78 and the coupler 76 mechanically connect the fast car door panel 28, the fast hoistway door panel 30, and the slow hoistway door panel 34. The slow car door panel 32 is independent.

Referring to FIG. 2, in the operation of the elevator the car 10 is directed to a particular landing 14. As the car 10 is positioned relative to the landing 14, the car door panels 28,32 and the hoistway door panels 30,34 are drawn along side one another. In the first embodiment, the rollers 52 of the first 44 and second 46 couplers are received within their respective vanes 54, thereby coupling the fast car 28 and hoistway 30 door panels, and the slow car 32 and hoistway 34 door panels. The first 40 and second 42 electromechanical drives then independently actuate the fast door panels 28,30 and the slow door panels 32,34, respectively, such that the stroke and speed of the fast door panels 28,30 is a multiple of the stroke and speed of the slow door panels 32,34.

Referring to FIG. 3, in the second embodiment when the car 10 is properly positioned at the landing 14, the rollers 52 of the first 64 and second 66 couplers for each set of fast 24 and slow 26 doors are received within their respective vanes 54, thereby coupling the fast car 28 and hoistway 30 door panels, and the slow car 32 and hoistway 34 door panels. The first 60 and second 62 electromechanical drives of each set of doors then independently actuate the fast door panels 28,30 and the slow door panels 32,34, respectively, such that the stroke and speed of the fast door panels 28,30 is a multiple of the stroke and speed of the slow door panels 32,34.

Referring to FIG. 4, in the third embodiment when the car 10 is properly positioned at the landing 14, the rollers 52 of the coupler 76 are received within the vane 54, thereby coupling the fast car 28 and hoistway 30 door panels, and the slow hoistway door panel 34. The slow car door panel 32 is connected to the second electromechanical drive 74 by the third linkage 82 and is therefore independently driven by the second electromechanical drive 74. The first electromechanical drive 72 independently actuates the fast door panels 28,30 and the slow hoistway door panel 34, respectively, such that the stroke and speed of the fast door panels 28,30 are a multiple of the stroke and speed of the slow hoistway door panel 34. The speed and stroke of the slow car door panel 32 are controlled to coordinate it with that of the slow hoistway door panel 34.

An advantage of the first and second embodiments is that the mass driven by either drive is less than it would be if a single drive drove both the fast and slow doors. Decreasing the mass decreases the kinetic energy of the telescoping door and thereby enables the elevator doors to be adjusted to a higher closing speed without exceeding the acceptable maximum kinetic energy. Similarly, the advantage of the third embodiment is that the mass of the door system in motion is less by the mass of the slow car door panel 32. The kinetic energy, therefore, is calculated using the mass of the fast door panels 28,30 and the slow hoistway door panel 34 on the one hand, and the mass of the slow car door panel 32 on the other hand.

Although the invention has been shown and described with respect to a best mode embodiment thereof, it should be understood by those skilled in the art that various other changes, omissions and additions in the form and detail thereof may be made therein without departing from the spirit and scope of the claimed invention.

I claim:

1. A telescoping elevator door apparatus for an elevator having a car for travel in a hoistway, comprising:

a fast elevator door, for operation between the car and a landing in the hoistway;

a slow elevator door, for operation between the car and said landing in the hoistway, wherein said fast elevator door is independent from said slow elevator door;

a first drive, for selectively driving said fast elevator door open or closed; and a second drive, for selectively driving said slow elevator door open or closed.

2. A telescoping elevator door apparatus for an elevator having a car for travel in a hoistway, comprising:

a fast car door panel, attached to the car;

a slow car door panel, attached to the car;

a fast hoistway door panel, attached to a landing in the hoistway;

a slow hoistway door panel, attached to said landing in the hoistway;

a first coupler, wherein said first coupler couples said fast hoistway door panel and said fast car door panel when the car is located at said landing;

a second coupler, wherein said second coupler couples said slow hoistway door panel and said slow car door panel when the car is located at said landing;

a first drive, for selectively driving said fast hoistway and car doors open or closed; and a second drive, for selectively driving said slow hoistway and car doors open or closed;

wherein said first and second drives respectively drive said fast hoistway and car door panels independently from said slow hoistway and car door panels.

3. A telescoping elevator door apparatus according to claim 2, wherein said first coupler comprises:

a roller, attached to one of said fast hoistway door panel and said fast car door panel; and a vane, attached to the other of said fast hoistway door panel and said fast car door panel;

wherein when the car is drawn to said landing, said roller is received within said vane, thereby coupling said fast hoistway and car doors.

4. A telescoping elevator door apparatus according to claim 3, wherein said second coupler comprises:

a roller, attached to one of said slow hoistway door panel and said slow car door panel; and a vane, attached to the other of said slow hoistway door panel and said slow car door panel;

wherein when the car is drawn to said landing, said roller is received within said vane, thereby coupling said slow hoistway and car doors.

5. A telescoping elevator door apparatus according to claim 4, wherein said first drive comprises:

a fast door panel actuator, attached to the car; and a fast door panel linkage, attached to said fast car door panel;

wherein said actuator actuates said linkage and thereby actuates said fast car door panel and said coupled fast hoistway door panel.

6. A telescoping elevator door apparatus according to claim 5, wherein said second drive comprises:

a slow door panel actuator, attached to the car; and a slow door panel linkage, attached to said slow car door panel;

wherein said actuator actuates said linkage and thereby actuates said slow car door panel and said coupled slow hoistway door panel.

7. A telescoping elevator door apparatus for an elevator having a car for travel in a hoistway, comprising:

a fast car door panel, attached to the car;

a slow car door panel, attached to the car;

a fast hoistway door panel, attached to a landing in the hoistway;

a slow hoistway door panel, attached to said landing in the hoistway;

a first linkage, said first linkage connecting said fast and slow hoistway door panels such that moving said slow hoistway door panel a distance causes said fast hoistway door panel to travel a multiple of said distance traveled by said slow hoistway door in the same period of time;

a coupler, wherein said coupler couples said fast hoistway door panel and said fast car door panel when the car is located at said landing;

a first drive, for selectively driving said fast car door panel, said fast hoistway door panel, and said slow hoistway door panel open or closed; and a second drive, for selectively driving said slow car door panel open or closed;

wherein said first and second drives respectively drive said fast and slow hoistway door panels and said fast car door panel independently from said slow car door panel.

8. A telescoping elevator door apparatus according to claim 7, wherein said second coupler comprises:

a roller, attached to one of said fast hoistway door panel and said fast car door panel;

a vane, attached to the other of said fast hoistway door panel and fast slow car door panel;

wherein when the car is drawn to said landing, said roller is received within said vane, thereby coupling said fast hoistway and car doors.

9. A telescoping elevator door apparatus according to claim 8, wherein said first drive comprises:

a first door panel actuator, attached to the car; and a fast car door panel linkage, attached to said fast car door panel and said first door panel actuator;

wherein said actuator actuates said linkage and thereby actuates said fast car door panel and said coupled fast hoistway door panel.

10. A telescoping elevator door apparatus according to claim 9, wherein said second drive comprises:

a slow car door panel actuator, attached to the car; and a slow car door panel linkage, attached to said slow car door panel and said slow door panel actuator;

wherein said slow car door panel actuator actuates said slow car door linkage and therefore said slow car door panel.

11. A telescoping door apparatus for an elevator, the door apparatus comprising:

a fast elevator door;

a slow elevator door;

a first drive, for selectively actuating said fast elevator door; and a second drive, for selectively actuating said slow elevator door, wherein said first and second drives independently actuate said fast and slow elevator doors.

12. The door apparatus according to claim 11, wherein the elevator includes a car, and wherein the fast elevator door includes a fast car door panel attached to the car.

13. The door apparatus according to claim 11, wherein the elevator includes a car, and wherein the slow elevator door includes a slow car door panel attached to the car.

14. The door apparatus according to claim 12, wherein the slow elevator door includes a slow car door panel attached to the car.

15. The door apparatus according to claim 12, wherein the fast elevator door further includes a fast hoistway door panel and a coupler that couples said fast car door panel and said fast hoistway door panel.

16. The door apparatus according to claim 13, wherein the slow elevator door includes a slow hoistway door panel and a coupler that couples said slow car door panel and said slow hoistway door panel.

17. The door apparatus according to claim 15, further including a slow hoistway door panel and a linkage that connects said fast and slow hoistway door panels such that both of said fast and slow hoistway door panels are actuated by said first drive.

* * * * *